United States Patent [19]

French et al.

[11] Patent Number: 4,808,876

[45] Date of Patent: Feb. 28, 1989

[54] METAL HALIDE LAMP

[75] Inventors: Park French, Aurora; Mary B. Gotti, Macedonia; John J. Karikas, Shelby; Gilbert H. Reiling, Chardon, all of Ohio

[73] Assignee: General Electric Company, Schenectady, N.Y.

[21] Appl. No.: 825,727

[22] Filed: Feb. 4, 1986

[51] Int. Cl.[4] ..... H01J 61/30; H01J 61/34

[52] U.S. Cl. ..... 313/25; 313/573; 313/623; 313/634; 313/635; 313/640; 313/641

[58] Field of Search ..... 313/25, 573, 623, 634, 313/635, 640, 641

[56] References Cited

U.S. PATENT DOCUMENTS

| | | | |
|---|---|---|---|
| 2,879,449 | 3/1959 | Macksound | 313/25 |
| 2,966,600 | 12/1960 | Strauss | 313/25 |
| 3,234,421 | 2/1966 | Reiling | 313/25 |
| 3,900,750 | 8/1975 | Bamberg et al. | 313/635 X |
| 3,937,996 | 2/1976 | Cap | 313/217 |
| 4,029,983 | 6/1977 | Thornton | 313/25 |
| 4,161,672 | 7/1979 | Cap et al. | 313/220 |
| 4,323,812 | 4/1982 | Wyner et al. | 313/601 |
| 4,387,319 | 6/1983 | White et al. | 313/634 X |
| 4,396,857 | 8/1983 | Danko | 313/634 |

FOREIGN PATENT DOCUMENTS

| | | | |
|---|---|---|---|
| 2125360 | 9/1972 | France | 313/640 |
| 0041875 | 11/1974 | Japan | 313/641 |
| 0093575 | 8/1976 | Japan | 313/641 |

*Primary Examiner*—David K. Moore
*Assistant Examiner*—Michael Horabik
*Attorney, Agent, or Firm*—Edward M. Corcoran; Stanley C. Corwin; Fred Jacob

[57] ABSTRACT

A metal halide discharge lamp includes an arc tube design having a particular end shape which allows control of the temperature distribution within the arc tube, so that sensitivity of the arc tube performance to orientation is reduced and concentration of the metallic halide components in the arc region is maintained relatively constant. The shaping of the arc tube ends and the use of a low thermal emissivity coating on the arc tube allows maintenance of the metallic halide in the vapor state at a constant level to promote better lumen maintenance and color rendering in a metal halide discharge lamp.

48 Claims, 1 Drawing Sheet

Fig. 1
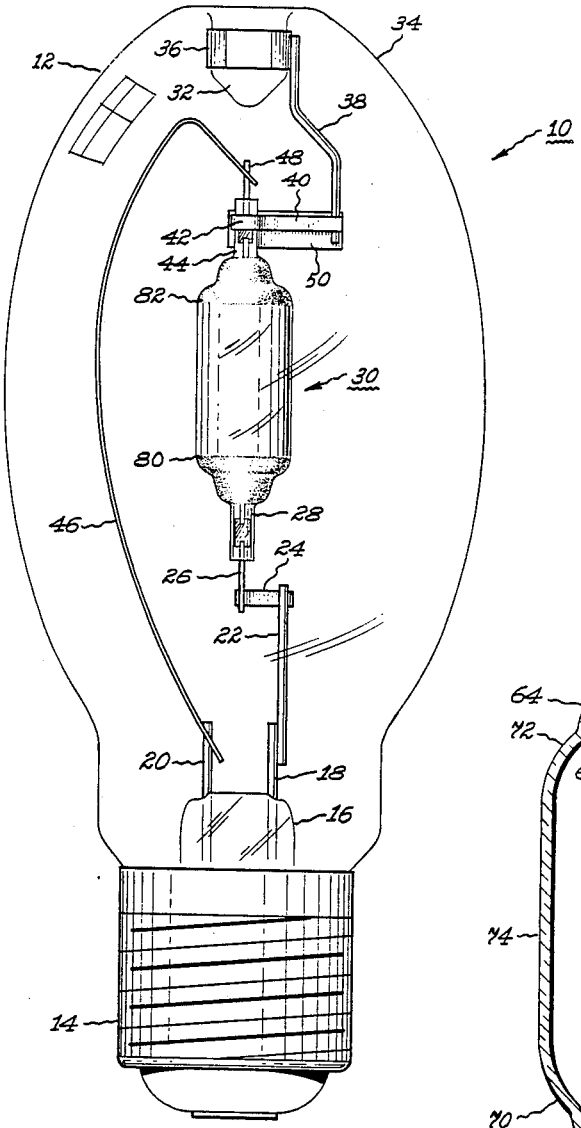
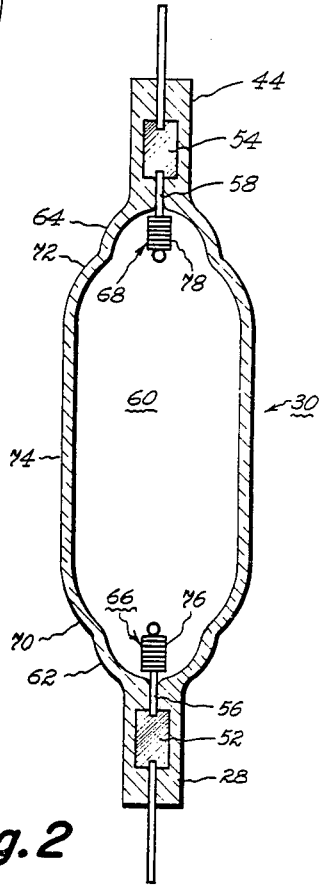
Fig. 2

METAL HALIDE LAMP

BACKGROUND OF THE INVENTION

1. Field of the Invention

The present invention relates to metal halide vapor discharge lamps, and, more particularly, to an arc tube construction and discharge operating composition which improve the lamp performance.

2. Description of the Prior Art

Metal halide lamps generally comprise an inner envelope or arc tube which is enclosed within a vitreous outer envelope or jacket. The inner envelope or arc tube contains a quantity of mercury, an inert starting gas and a quantity of one or more metallic halides. Lamp color and efficacy, or lumens per watt, of metal vapor discharge lamps are affected by the vapor pressure of the halides in the arc during operation, which is affected by wall temperature of the arc chamber. Wall temperatures of the arc chamber are determined by the input power to the arc chamber, the geometry and orientation of the arc chamber and the design of the arc electrodes. Wall temperatures are also affected by convection speeds and flow patterns, arc radiation efficiency and the amount of wall coverage by metal halides. Condensation of metal halides and accumulation of the condensate at a relatively cool location within the arc tube reduces lamp efficiency and can result in sudden vaporization of condensate, flaring, which adversely affects color rendering in the operating lamp. Condensation of the metal halides in the end chambers, particularly in the regions where the electrodes emerge from the vitreous material, is undesirable in that the temperatures of these regions is strongly affected by manufacturing variations, causing corresponding variations in the metal halide vapor pressures and thus also in lamp performance. Preventing accumulation of condensate close to the electrodes is therefore an aim of metal halide arc tube design when close control of color is desired. In order to provide a particular lamp color and efficacy in terms of lumens of light output per watt of electricity consumed, various attempts have been made in the prior art to shape the arc chamber and select the discharge medium materials to allow flexibility in orientation of the lamp during normal operation and in selecting the color temperature of the lamp. In standard lamps, large differences in halide vapor pressure exist between horizontal and vertical operation, primarily because of the differences in the condensed halide temperatures in these orientations. In horizontal operation the arc floats to the top of the arc tube, and condensate tends to accumulate on the lower arc tube wall, which is further from the arc and cooler than the walls and end chambers in vertical operation. The result is generally a marked reduction in halide vapor density for horizontal operation and consequently for the radiating metal densities in the arc, which result from thermal dissociation of the metal halides. The reduced metal densities generally result in increased color temperatures and decreased efficacies as compared to vertical operation. Further, in certain applications, for example the illumination of an object, such as the Statue of Liberty, which limits the positioning of lamps for illumination, a lamp operable at orientations such that the arc tube is oriented other than vertically is highly desirable.

SUMMARY OF THE INVENTION

An object of the present invention is to provide an arc tube with low heat losses from the ends, in combination with a shaped arc chamber for metal vapor discharge lamps in which the lamp electrodes are positioned in reduced cross section ends of the arc tube so that the metal halides within the arc chamber during lamp operation are prevented from condensing in the ends. A more particular object of the present invention is to provide a lamp combination including a discharge medium and arc tube shape selected to obtain high and uniform efficacy with a desired color temperature over a range of operating orientations.

In accordance with the present invention a metal halide discharge lamp having an outer envelope with a threaded base at one end thereof includes a sealed arc tube disposed within the outer envelope having a particular end shape, a pair of arc discharge electrodes projecting into the interior of the arc tube and sealed into generally cylindrical seals at each respective end of the arc tube and connected by electrical leads to electrical terminals connected to the base of the outer envelope, and a low thermal emissivity material disposed on at least one of the shaped arc tube ends. The present invention further includes use of particular metal halides as components of the discharge medium disposed within the arc tube to provide particular desired wavelengths of electromagnetic radiation during normal operation of the lamp.

BRIEF DESCRIPTION OF THE DRAWINGS

Further objects and advantages of the present invention together with its organization, method of operation and best mode contemplated may best be understood by reference to the following description taken in conjunction with the accompanying drawings, in which like reference characters refer to like elements throughout, and in which:

FIG. 1 is a schematic elevation view illustrating a lamp incorporating an arc tube construction according to the present invention; and FIG. 2 is a schematic partial cross-sectional view of one preferred embodiment of the arc tube of the present invention.

DESCRIPTION OF THE PREFERRED EMBODIMENTS

A lamp made according to the present invention is illustrated schematically in FIG. 1. The lamp 10 includes an outer envelope 12 of vitreous material, such as glass having a composition suitable for a high intensity discharge lamp, and a base 14 having suitable electrical contacts for making electrical connection to an appropriate source of electrical power. The space within the envelope 12 may be evacuated to a pressure of not more than about $10^{-4}$ torr or filled with nitrogen gas up to a pressure of about 380 torr. The end cap 14 surrounds the stem 16 of the outer envelope through which electrically conductive terminal wires 18 and 20 extend. Terminal 18 is connected to one end of support rod 22 for example by welding. An electrically conductive member 24 is attached to the opposite end of support rod 22 and is connected to one of the electrically conductive inleads 26 which extends through arc tube stem 28 of arc tube 30. An anchoring dimple 32 is provided at the closed end 34 of the outer envelope 12. A metallic collar 36 may be disposed around dimple 32 and connected, e.g. by welding, to one end of support rod 38 whose other end is attached, e.g. by welding, to support member 40 which includes a ring 42 surrounding arc tube stem 44 to provide support for the arc tube 30 within the outer envelope 12. An electrically conductive lead wire 46 is connected, e.g. by welding, to terminal 20 at one end and is connected, e.g. by welding, to electrically conductive inlead 48 which passes through stem member 44 of the arc tube 30. A getter strip 50 coated with a material to absorb hydrogen and water vapor from the inside of the outer envelope 12 may be attached, for example by welding, to support rod 38.

The arc tube 30 is shown in greater detail in FIG. 2. The arc tube 30 includes an envelope of vitreous material, such as thin walled, fused silica, sealed at the respective ends by small diameter heat-conserving stems 28 and 44 through which the lamp inleads extend to make electrical contact with the metal foil conductors 52, 54 which are connected to respective electrode stems 56, 58 at the respective ends of the arc chamber 60 within the arc tube. Each of the respective ends of the arc tube envelope is shaped to have a narrow, generally hemispherically shaped neck 62, 64 surrounding the respective lamp electrode 66, 68 joined to a larger generally hemispherically shaped arc tube end portion 70, 72 through which the end of the arc tube expands rapidly but smoothly to the full diameter of the generally cylindrical center portion 74 of the arc tube. The radius of each of the arc tube end portions 70, 72 is larger than the radius of the necks 62, 64 but may be larger than, smaller than or equal to the radius of the center portion 74. The lamp electrodes extend through the respective end shrink seals into the interior of the arc tube by predetermined insertion distances. The insertion distance and the spacing between the tips of electrodes 66, 68 are selected in combination with the quantity of metal halide discharge medium so that the proper vaporization is maintained within the lamp during normal operation. Low thermal emissivity coatings, e.g. zirconium oxide, as shown at 80 and 82 in FIG. 1 are disposed on the exterior of the arc tube at its respective ends to reduce radiative heat loss from the ends and to reflect heat into the arc chamber to help maintain vaporization of the metal halides disposed within the arc chamber. The present invention also includes an arc tube as described above with a coating disposed upon only one end of the arc tube. The arc tube is disposed within the outer envelope such that the coated end of the arc tube is disposed at the bottom during lamp operation, if only one end of the arc tube is coated. The use of the small diameter generally cylindrical arc tube stems which are sealed at the foil members 52, 54 results in a smaller, less heat dissipative seal than conventional pinch seals, so that during lamp operation less energy is lost from the arc tube ends, so that the end chambers within the necks 62, 64 are consequently hotter, which condition helps prevent the condensation of metal halides in the end chambers. A suitable filling is disposed within the arc chamber and typically comprises a quantity of mercury, an inert starting gas and an amount of metal halide dose sufficient to provide an arc medium within the arc tube during normal operation of the lamp. The electrodes 66, 68 typically comprise tungsten having a diameter of approximately 0.69 mm with a tungsten overwind 76, 78 approximately 3 mm long. The electrode stems 56, 58 each contain from about 1 to about 2 percent thorium oxide.

The elimination of condensed metal halides from the lamp end chambers is necessary in order to control color and efficacy of metal halide lamps. Condensed metal halides tend to be gravitationally induced to enter the lower end chamber when the arc tube is operating at a generally vertical orientation. In the present invention the use of small diameter shrink seals 28, 44, narrow end necks 62, 64, electrode insertion distances selected so that the end chambers are further heated by their proximity to the arc ends and the hot electrodes, and the external low-emissivity end coatings 80, 82 for suppressing radiative heat loss act together to prevent collection of the condensed metal halides in the end chambers within necks 62, 64. The elimination of metal halide condensation also decreases the changes in color and efficacy resulting from manufacturing variations and changes in the operating angle of the arc tube with respect to the vertical as compared to prior art metal halide lamps.

Another major advantage of the present invention is the use of lower than usual mercury vapor densities, as compared to standard metal halide lamps at the 150–400 watt power range. The filling may preferably comprise, for example, 14 to 24 mg of mercury in an amalgam containing 0 to 3 mg cadmium; 5 to 25 mg of halides selected from the group including sodium iodide, scandium iodide, dysprosium iodide, holmium iodide, thulium iodide, cesium iodide and thallium iodide; and an inert starting gas such as argon at a pressure of approximately 60 torr. The arc tube as measured between the arc tube stem members is typically about 39–43 millimeters long and about 15–17 millimeters in outside diameter. The stems each have a diameter of about 5 millimeters. The end members are typically generally hemispherically shaped with an outer radius of about 4–6 millimeters, and the shoulder end shapes are generally hemispherically shaped with an outer diameter of about 15–17 millimeters to match that of the center section. The electrode spacing is typically about 28 to about 33 millimeters. In the present invention the use of lower than usual mercury densities reduces the convective velocities of the arc tube gases through the arc. In vertical operation, the reduced flow velocities of the gas along the axis of the arc provide for much increased loss of radiating metals from the arc by radial diffusion, thereby resulting in substantially lower metal densities in the upper portion of the arc than in the lower portion, and reducing the average radiating metal density in the arc. In horizontal operation the gases flow transversely through the arc and, because of the narrowness of the arc, they pass through it quickly and diffusion losses of the metals are very small. By proper choice of the mercury dose the convective velocity of the arc tube gases can be controlled so that the average metal vapor density will be approximately the same for either vertical or horizontal operation of the arc tube. The result is much less sensitivity of the color and efficacy of the lamp to orientation changes than is common for standard metal halide discharge lamps. The average metal density is proportional to the metal halide vapor density, which is controlled by the thermal design of the lamp, by the arc tube wall loading, and by the composition and quantity of the metal halide dose to yield the desired color temperature and efficacy. We have found that the present invention allows operation of the arc tube at any angle from vertical to about 20° above horizontal, with only small changes in color and efficacy. The use of the discharge medium of the present invention also provides a metal halide lamp having a low wall loading of about 12 watts per square centimeter which provides a much improved operating life. The special features of the present invention raise arc tube end temperatures and result in efficacies as high as in standard lamps, while providing much less sensitivity to orientation.

Another feature of the present invention is to allow for different color output. When an arc is struck in a metal halide lamp the light output is low until the metallic halides evaporate and the mercury evaporates causing an increase in the pressure. The wall temperature stabilizes around 750° C. and the arc temperature increases to about 4500° C. at the center of the arc. At this temperature the arc dissociates the metallic halides into the electronegative portion, e.g. iodine, and the metallic portion such as sodium, scandium, dysprosium or thallium. It is the metallic portion which is easily excited and emits a spectrum characteristic of the metal. In highly loaded lamps of the prior art the color temperature establishes itself and cannot be easily varied. In the present invention the use of a particular metallic component having a characteristic spectrum, or the use of a combination of metallic components having a particular combination of spectra, allows selection of color temperature of the radiation output by the lamp. Several combinations of different metals can be used to produce desired colors. Mercury, iodine and argon are also present in the arc stream but are not easily excited at the arc temperatures found in these metal halide lamps, and therefore their spectrum is weak and not an effective radiator so that these components of the fill are not strong contributors to the light emitted.

In one preferred embodiment of the present invention the separation between the tips of the electrodes was about 32 millimeters. The fill comprised argon in a quantity sufficient to provide a partial pressure of about 50 torr, about 5 milligrams of a combination of about equal molar percents of holmium iodide, thulium iodide, cesium iodide, dysprosium iodide and thallium iodide, and about 16 mg of mercury. The discharge lamp, when Operated on a peak lead ballast with an external starter at 250 watts when stabilized, provided light output at a color temperature of 5200° K. and an efficacy typical of metal halide lamps.

In a second preferred embodiment, the electrode separation was about 32 millimeters with a fill of argon at about 50 torr, 33 milligrams of a combination of about 95 molar percent sodium iodide and about 5 molar percent scandium iodides, and about 18 milligrams of mercury. When operated on a peak lead ballast at about 250 watts, this lamp provided light output at a color temperature of about 3800° K. As will be appreciated, many other color temperatures may be provided by selection of materials as described hereinabove.

As will be appreciated by those skilled in the art, the present invention provides a metal halide discharge lamp which accomplishes the objectives of reduced sensitivity to orientation during normal operation and selectivity of color temperature while maintaining high efficacy and long life.

What we claim as new and desire to secure by Letter patent of the United States is:

1. An arc tube for a metal vapor discharge lamp for operation in a power range of about 150–400 watts, at a color temperature of about 5200° K. and at any angle from vertical to about 20° above horizontal with only small changes in color and efficacy, which comprises a cylindrical, hollow, vitreous, light transmissive envelope terminating at each end in an area of reduced cross section with each of said areas of reduced cross section comprising a narrow, generally hemispherically shaped neck portion joined to a larger, generally hemispherically shaped arc tube end portion which expands rapidly, but smoothly to the full diameter of said arc tube wherein the radius of said end portion is greater than the radius of said neck portion and each of said end portions surrounds an electrode made of tungsten wire contained within and which extends through each end of said arc tube through generally cylindrical stem means attached to said neck portion which seals each end of said arc tube with said electrode having an overwind extending towards said stem means, said stem means having a diameter smaller than said neck portion, wherein said arc tube contains mercury, an inert gas and, optionally, up to 3% Cd, along with metal halides of holmium iodide, thulium iodide, cesium dysprosium iodide and thallium iodide, with the external surface of at least the bottom neck portion of said arc tube coated with a heat reflective coating and wherein said electrodes within said arc tube contain thorium oxide.

2. The arc tube of claim 1 having an overall length of about 39–43 millimeters and a diameter ranging between about 15–17 millimeters.

3. The arc tube of claim 2 wherein the distance between the ends of both electrodes within said arc tube range between 28–33 millimeters.

4. The arc tube of claim 3 wherein the amount of mercury in said arc tube ranges between about 14–24 milligrams.

5. The arc tube of claim 4 wherein the amount of said metal halides in said arc tube ranges between about 5–25 milligrams.

6. The arc tube of claim 4 wherein said coating covers the external surface of both neck portions and stems of said arc tube.

7. The arc tube of claim 6 wherein said metal halides consists essentially of a mixture of holmium iodide, thullium iodide, cesium iodide, dysprosium iodide, and thallium iodide.

8. The arc tube of claim 7 wherein said metal halides are present in equal molar quantities.

9. The arc tube of claim 8 wherein the distance between said electrodes is about 32 millimeters and said electrode wire is of a diameter of about 0.69 mm and said overwind extends about 3 mm towards said seal means.

10. The arc tube of claim 9 wherein said inert gas is argon.

11. The arc tube of claim 10 which contains mercury in an amount of about 16 milligrams and said metal halide in an amount of about 5 milligrams.

12. The arc tube of claim 11 wherein said argon is at a pressure of about 50 torr.

13. The arc tube of claim 12 having a wall loading of about 12 watts per square centimeter.

14. The arc tube of claim 13 operating at about 250 watts.

15. A metal halide lamp for operation (i) at any angle from vertical to about 20° above horizontal with only small changes in color and efficacy, (ii) in a power range of about 150–400 watts and (iii) at a color temperature of about 5200° K., which comprises an outer envelope of vitreous, light transmissive material with an electric arc tube light source contained within, wherein said arc tube comprises a cylindrical, hollow, vitreous, light transmissive envelope terminating at each end in an area of reduced cross section with each of said areas of reduced cross section comprising a narrow, generally hemispherically shaped neck portion joined to a larger, generally hemispherically shaped arc tube end portion which expands rapidly, but smoothly to the full diameter of said arc tube wherein the radius of said end portion is greater than the radius of said neck portion and each of said end portions surrounds an electrode made of tungsten wire contained within and which extends through each end of said arc tube through generally cylindrical stem means attached to said neck portion which seals each end of said arc tube with said electrode having an overwind extending towards said stem means, said stem means having a diameter smaller than said neck portion, wherein said arc tube contains mercury, an inert gas and, up to 3% Cd, along with metal halides of holmium iodide, thulium iodide, cesium dysprosium iodide and thallium iodide, with the external surface of at least the bottom neck portion of said arc tube coated with a heat reflective coating and wherein said electrodes within said arc tube contain thorium oxide.

16. The lamp of claim 15 wherein said arc tube has an overall length of about 39–43 millimeters and a diameter ranging between about 15–17 millimeters.

17. The lamp of claim 16 wherein the distance between the ends of both electrodes within said arc tube range between 28–33 millimeters.

18. The lamp of claim 17 wherein the amount of mercury in said arc tube ranges between about 14–24 milligrams.

19. The lamp or claim wherein the amount of said metal halides in said arc tube ranges between about 5–25 milligrams.

20. The lamp of claim 19 wherein said arc tube coating covers the external surface of both neck portions and stems of said arc tube.

21. The lamp of claim 20 wherein said metal halide consists essentially of a mixture of holmium iodide, thullium iodide, cesium iodide, dysprosium iodide, and thallium iodide.

22. The lamp of claim 21 wherein said metal halides are present in equal molar quantities.

23. The lamp of claim 22 wherein said inert gas is argon.

24. The lamp of claim 23 wherein the distance between said electrodes is about 32 millimeters and said electrode wire has a diameter of about 0.69 mm and said overwind extends about 3 mm towards said seal means.

25. The lamp of claim 24 which contains mercury in an amount of about 16 milligrams and said metal halides in an amount of about 5 milligrams.

26. The lamp of claim 24 wherein said argon is at a pressure about 50 torr.

27. The lamp of claim 26 having a wall loading of about 12 watts per square centimeter.

28. The arc tube of claim 15 operating at about 250 watts.

29. An arc tube for a metal vapor discharge lamp for operation (i) at any angle from vertical to about 20° above horizontal with only small changes in color and efficacy, (ii) in a power range of about 15–400 watts and (iii) at a color temperature of about 3800° K., which comprises a cylindrical, hollow, vitreous, light transmissive envelope terminating at each end in an area of reduced cross section with each of said areas of reduced cross section comprising a narrow, generally hemispherically shaped neck portion joined to a larger, generally hemispherically shaped arc tube end portion which expands rapidly, but smoothly to the full diameter of said arc tube wherein the radius of said end portion is greater than the radius of said neck portion and each of said end portions surrounds an electrode contained within made of tungsten wire and which extends through each end of said arc tube through generally cylindrical stem means attached to said neck portion which seals each end of said arc tube with said electrode having an overwind extending towards said stem means, said stem means having a diameter smaller than said neck portion, wherein said arc tube contains mercury, an inert gas and, up to 3% Cd, along with metal halides of sodium iodide and scandium iodide, with the surface of at least the bottom neck portion of said arc tube coated with a heat reflective coating and wherein said electrodes within said arc tube contain thorium oxide.

30. The arc tube of claim 29 having an overall length of about 39–43 millimeters and a diameter ranging between about 15–17 millimeters.

31. The arc tube of claim 30 wherein the distance between the ends of both electrodes within said arc tube ranges between 28–33 millimeters.

32. The arc tube of claim 31 wherein the amount of mercury in said arc tube ranges between about 14–24 milligrams.

33. The arc tube of claim 32 wherein the amount of said metal halide in said arc tube ranges between about 5–25 milligrams and wherein said electrode has a diameter about 0.69 mm and said overwind extends about 3 mm towards said seal means.

34. The arc tube of claim 33 wherein said coating covers the external surface of both neck portions and stems of said arc tube.

35. The arc tube of claim 34 wherein said inert gas is argon.

36. The arc tube of claim 35 wherein said argon is at a pressure about 50 torr.

37. The arc tube of claim 36 operating at about 250 watts.

38. An electric lamp for operation at any angle from vertical to about 20° above horizontal with only small changes in color and efficacy, in a power range of about 150–400 watts and at a color temperature of about 3800° K., which comprises an outer envelope of vitreous, light transmissive material with an electric arc tube light source contained within said outer envelope wherein said tube comprises a cylindrical, hollow, vitreous, light transmissive envelope terminating at each end in an area of reduced cross section with each of said areas of reduced cross section comprising a narrow, generally hemispherically shaped neck portion joined to a larger, generally hemispherically shaped arc tube end portion which expands rapidly, but smoothly to the full diameter of said arc tube wherein the radius of said end portion is greater than the radius of said neck portion and each of said end portions surrounds an electrode made of tungsten wire contained within and which extends through generally cylindrical stem means attached to said neck portion which seals each end of said arc tube with said electrode having an overwind extending towards said stem means, said stem means having a diameter smaller than said neck portion, wherein said arc tube contains mercury, an inert gas and, up to 3% Cd, along with metal halides of sodium iodide and scandium iodide and with the external surface of at least the bottom neck portion of said arc tube coated with a heat reflective coating and wherein said electrodes within said arc tube contain thorium oxide.

39. The lamp of claim 38 wherein said arc tube has an overall length of about 39–43 millimeters and a diameter ranging between about 15-17 millimeters.

40. The lamp of claim 39 wherein the distance between the ends of both electrodes within said arc tube range between 28–33 millimeters.

41. The lamp of claim 40 wherein the amount of mercury in said arc tube ranges between about 14–24 milligrams.

42. The lamp of claim 41 wherein the amount of said metal halides in said arc tube ranges between about 5–25 milligrams.

43. The lamp of claim 42 wherein said arc tube coating covers the external surface of both neck portions and stems of said arc tube.

44. The lamp of claim 43 wherein the distance between said electrodes in said arc tube is about 32 millimeters and the diameter of said wires is about 0.69 mm and said overwind extends about 3 mm towards said seal means.

45. The lamp of claim 44 wherein said inert gas is argon.

46. The lamp of claim 45 wherein said argon is at a pressure of about 50 torr.

47. The lamp of claim 46 wherein said arc tube contains mercury in an amount of about 18 milligrams.

48. The lamp of claim 47 operating at about 250 watts.

* * * * *